US007121108B2

(12) United States Patent
Lee

(10) Patent No.: US 7,121,108 B2
(45) Date of Patent: Oct. 17, 2006

(54) COVER ASSEMBLY OF MACHINERY CHAMBER IN REFRIGERATOR

(75) Inventor: Chang Lim Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/824,379

(22) Filed: Apr. 15, 2004

(65) Prior Publication Data

US 2004/0206105 A1 Oct. 21, 2004

(30) Foreign Application Priority Data

Apr. 17, 2003 (KR) ..... 10-2003-0024211

(51) Int. Cl.
*B67D 5/62* (2006.01)

(52) U.S. Cl. ..... 62/389

(58) Field of Classification Search ..... 62/295.1, 62/265, 298, 389, 338, 295; 137/533.13, 137/533.19, 533.31, 624.16; 251/339, 366; 222/146.6

See application file for complete search history.

(56) References Cited

U.S. PATENT DOCUMENTS

| | | | | | |
|---|---|---|---|---|---|
| 3,946,573 | A | * | 3/1976 | Nichols et al. | 62/126 |
| 4,036,620 | A | * | 7/1977 | Benasutti et al. | 62/338 |
| 4,095,916 | A | * | 6/1978 | Hammond | 408/1 R |
| 4,265,089 | A | * | 5/1981 | Webb | 62/72 |
| 4,543,800 | A | * | 10/1985 | Mawby et al. | 62/339 |
| 4,787,216 | A | * | 11/1988 | Chesnut et al. | 62/347 |
| 4,848,097 | A | * | 7/1989 | Roberts | 62/135 |
| 5,511,388 | A | * | 4/1996 | Taylor et al. | 62/389 |
| 5,551,598 | A | * | 9/1996 | Cutsinger | 222/52 |
| 5,810,331 | A | * | 9/1998 | Smock et al. | 251/148 |
| 5,836,170 | A | * | 11/1998 | Perkins et al. | 62/409 |
| 6,161,390 | A | * | 12/2000 | Kim | 62/72 |
| 6,276,146 | B1 | * | 8/2001 | Kim et al. | 62/66 |
| 6,412,645 | B1 | * | 7/2002 | DuHack | 210/435 |
| 6,422,258 | B1 | * | 7/2002 | DuHack et al. | 137/15.09 |
| 6,532,751 | B1 | * | 3/2003 | Schenk et al. | 62/66 |
| 6,615,858 | B1 | * | 9/2003 | DuHack et al. | 137/15.09 |
| 6,679,073 | B1 | * | 1/2004 | Hu | 62/135 |
| 6,741,236 | B1 | * | 5/2004 | Yun | 345/173 |
| 6,810,682 | B1 | * | 11/2004 | Schuchart et al. | 62/98 |
| 6,896,159 | B1 | * | 5/2005 | Crisp et al. | 222/146.6 |
| 2002/0092869 | A1 | * | 7/2002 | Tiemann et al. | 222/249 |

FOREIGN PATENT DOCUMENTS

| | | | |
|---|---|---|---|
| JP | 7-63473 A | * | 3/1995 |
| JP | 8-226749 | * | 9/1996 |
| JP | 09-243237 A | * | 9/1997 |
| JP | 10-103827 A | * | 4/1998 |
| KR | 1020020067177 | | 8/2002 |

* cited by examiner

*Primary Examiner*—Mohammad M. Ali
(74) *Attorney, Agent, or Firm*—Birch, Stewart, Kolasch & Birch, LLP

(57) ABSTRACT

Refrigerator including a machinery chamber in a cabinet of the refrigerator having components provided therein, the components including a valve for connecting to a hose to supply water to the refrigerator, a cover attached to the cabinet to cover the machinery chamber, an opening provided to the cover to opposite to the valve, and a protection cap detachably fastened to the cover to cover the opening.

17 Claims, 4 Drawing Sheets

COVER ASSEMBLY OF MACHINERY CHAMBER IN REFRIGERATOR

This application claims the benefit of the Korean Application No. P2003-24211 filed on Apr. 17, 2003, which is hereby incorporated by reference.

BACKGROUND OF THE INVENTION

1. Field of the Invention

The present invention relates to refrigerators, and more particularly, to a cover assembly for covering a machinery chamber of a refrigerator.

2. Background of the Related Art

The refrigerator is used for long term fresh storage of food. The refrigerator has food storage chambers, maintained in a low temperature state by a refrigerating cycle for maintaining the food in a fresh state.

Recently, besides above traditional function of the refrigerator, refrigerators having additive functions are developed. As a typical example, a refrigerator having a dispenser is developed for dispensing water or ice to a user without opening a door on the refrigerator.

However, the refrigerator having the dispenser is required to have water supplied thereto from an outside of the refrigerator. As shown in FIGS. 1 and 2, the refrigerator having the dispenser is provided with a waver valve 20 in a machinery chamber, to which hoses connected to a water supply source and the dispenser (not shown) are connected.

The machinery chamber, in a lower portion of rear of a cabinet 10 of the refrigerator, has a compressor (not shown), a condenser (not shown), the water valve 20, and the like provided therein.

Referring to FIGS. 1 and 2, the water valve 20 has a first hose 30 connected to an external water supply source. The water valve 20 is also connected to a second hose (not shown) connected to the dispenser (not shown).

Therefore, it is convenient such that the refrigerator can have the water supplied thereto through the first hose 30 continuously, and the user can be supplied with cold water or ice through the dispenser (not shown).

In the foregoing refrigerator, the machinery chamber is in general covered with a cover 40. Therefore, in order to connect/disconnect the first hose 30 to/from the water valve 20, it is required to remove the cover 40 from the cabinet 10, or put the cover 40 on the cabinet 10 again, after service is finished. Therefore, the service is not convenient.

For solving the problem, a structure may be suggested in which the water valve itself is exposed to an outside of the machinery chamber. However, in this case, the valve is liable to suffer from damage when the refrigerator is moved or transported.

SUMMARY OF THE INVENTION

Accordingly, the present invention is directed to a cover assembly for covering a machinery chamber of a refrigerator that substantially obviates one or more of the problems due to limitations and disadvantages of the related art.

An object of the present invention, designed to solve the foregoing problem, lies on improving a structure of a cover assembly for easy connection/disconnection of hoses to/from a water valve in a machinery chamber of a refrigerator.

Another object of the present invention is to provide a cover assembly which can protect a water valve in a machinery chamber of a refrigerator in safety.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the cover assembly of a machinery chamber in a refrigerator includes a cover for covering a machinery chamber having a valve provided thereto, the valve being connected to a hose for supplying water to the refrigerator, an opening provided to the cover to opposite to the valve, and a protection cap detachably fastened to the cover to cover the opening.

In other aspect of the present invention, there is provided a refrigerator including a machinery chamber in a cabinet of the refrigerator having components provided therein, the components including a valve for connecting to a hose to supply water to the refrigerator, a cover attached to the cabinet to cover the machinery chamber, an opening provided to the cover to opposite to the valve, and a protection cap detachably fastened to the cover to cover the opening.

The cover is preferably detachable from the cabinet the machinery chamber is formed therein. The cover is fastened to the cabinet having the machinery chamber formed therein with screws or bolts.

The opening has a size larger than a size of the valve. Preferably, the opening exposes a portion at which the valve and the hose are connected.

The protection cap may be fastened to the cover with screws or bolts;

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE PREFERRED EMBODIMENT

Reference will now be made in detail to the preferred embodiments of the present invention, examples of which are illustrated in the accompanying drawings. In describing the embodiments of the present invention, identical parts will be given the same names and reference symbols, and repetitive description of which will be omitted.

Figure 1:
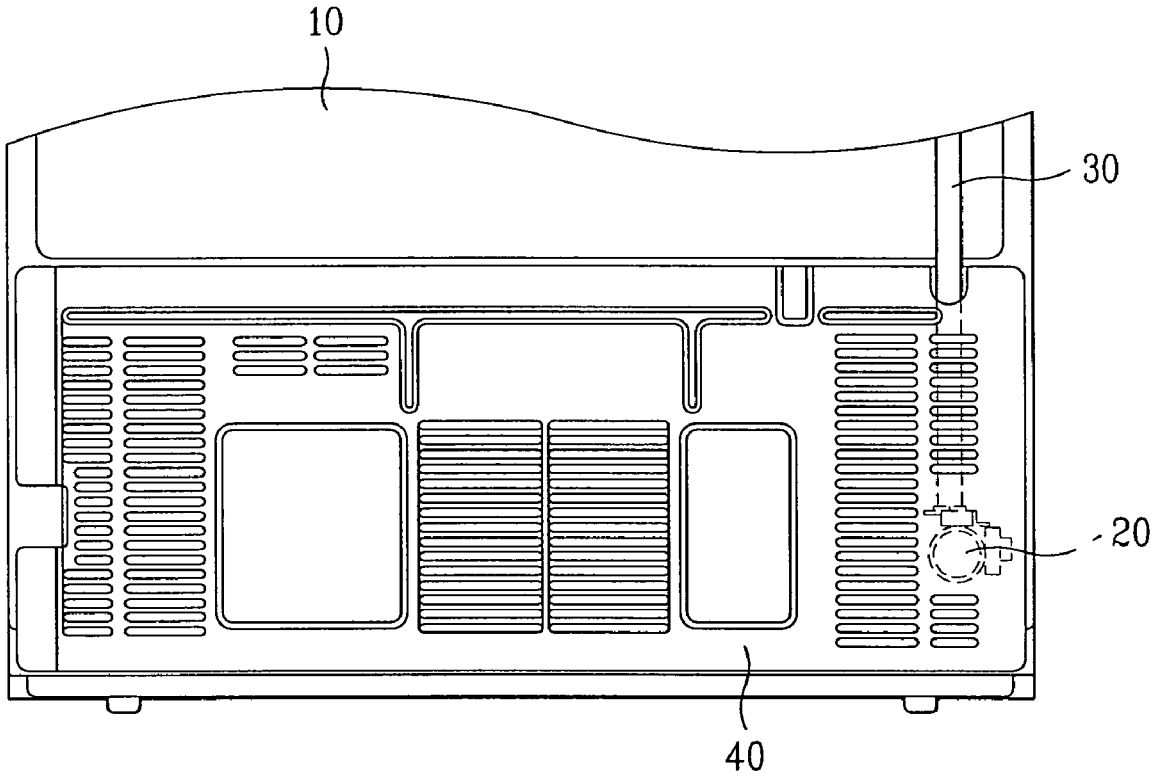
FIG. 1 Related Art
FIG. 1 illustrates a front view of a related art cover assembly of a machinery chamber in a refrigerator.
Figure 2:
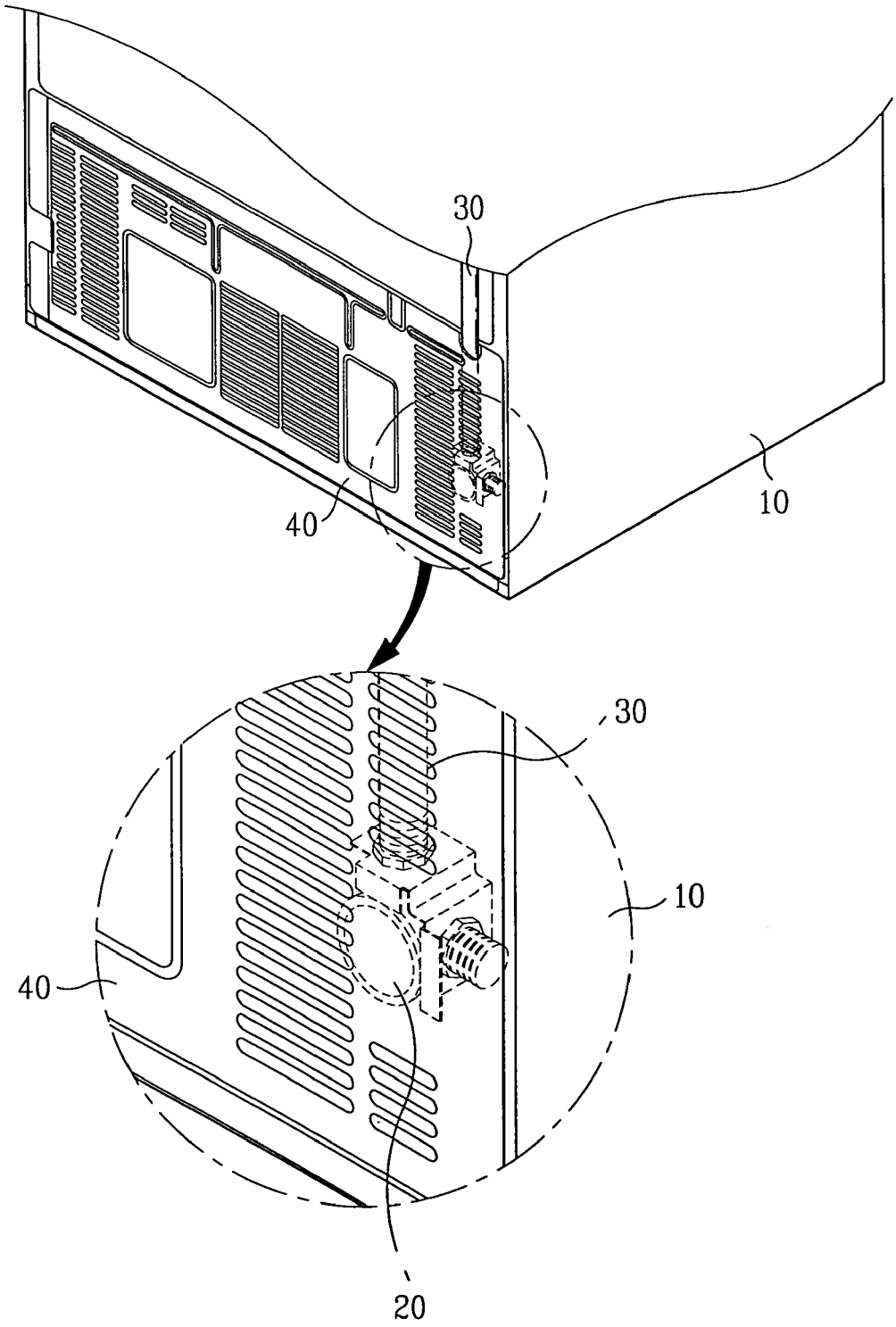
FIG. 2 Related Art
FIG. 2 illustrates a perspective view of the cover assembly in FIG. 1.
Figure 3:
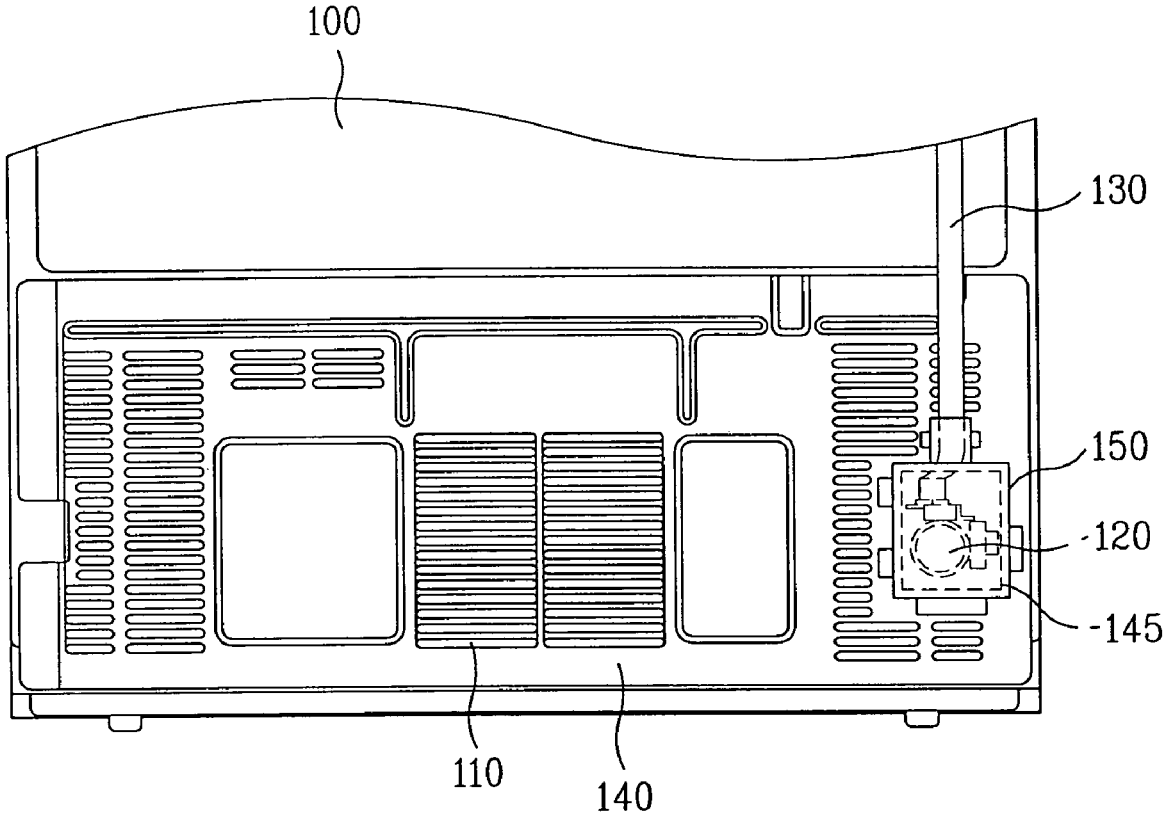
FIG. 3 illustrates a back view of a cover assembly of a machinery chamber in a refrigerator in accordance with a preferred embodiment of the present invention.
Figure 4:
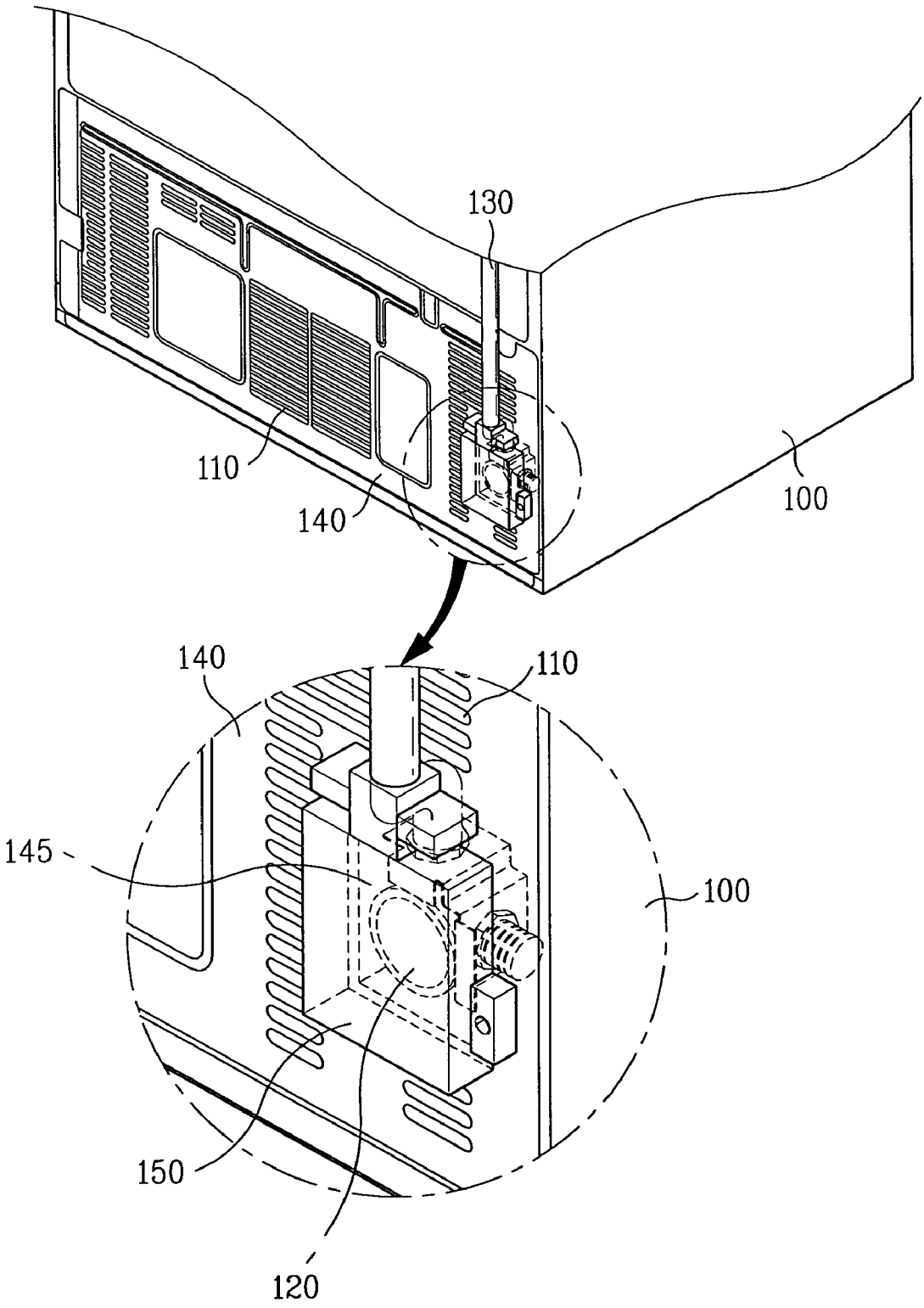
FIG. 4 illustrates a perspective view of the cover assembly of FIG. 3.

FIG. 3 illustrates a back view of a cover assembly of a machinery chamber in a refrigerator in accordance with a preferred embodiment of the present invention, and FIG. 4 illustrates a perspective view of the cover assembly of FIG. 3.

Referring to FIGS. 3 and 4, there is a machinery chamber (not shown) of a refrigerator in a lower portion of rear of a cabinet of the refrigerator. The machinery chamber has components, such as a compressor (not shown), a condenser (not shown), a water valve 120, and the like mounted therein. The compressor and the condenser are used in all general refrigerators, for compressing and condensing the refrigerant. Therefore, no more description of the compressor and condenser will be given.

The water valve 120 supplies water to a dispenser that supplies cold water to a user. For this, the water valve 120 and the dispenser is connected with an internal hose, and, as shown in FIGS. 3 and 4, a hose is connected between a water supply source, such as faucet and the water valve 120. In the meantime, the water valve may supply water, not only to the dispenser that supplies cold water to the user, but also an icemaker that produces ice.

In the meantime, one side of the machinery chamber is opened, and a cover 140 is attached to the cabinet 100 to cover the machinery chamber. The cover 140, fastened to the cabinet 100 with screws or bolts, is detachable.

In the meantime, the cover 140 has an opening 145. The opening 145 is formed at a position opposite to the water valve when the cover 140 covers the machinery chamber.

Therefore, a service man can insert a hand or tool into the machinery chamber through the opening 145. Therefore, the user can connect/disconnect the hose 130 to/from the water valve 120 even in a state the cover is not removed from the cabinet 100.

Since the opening 145 is provided for inserting the hand or the tool, it is preferable that the opening 145 has an adequate size for the serviceman to service with easy. Therefore, it is preferable that the opening 145 is formed larger than a size of the water valve 120. Especially, it is preferable that the opening 145 has an adequate size that can expose a portion at which the water valve 120 and the hose 130 are connected.

In the meantime, the cover 140 has a protection cap 150 for covering the opening 145. The protection cap 150 is detachable from the cover 140, and fastened to the cover 140 with, for an example, screws or bolts. For this, the cover 140 has a plurality of screw holes (not shown) around the opening 145.

Though an embodiment in which the protection cap 150 is fastened to the cover 140 with screws or bolts are described, the protection cap 150 may be fastened to the cover 140 with other fastening means.

For an example, a hook may be formed on one of the protection cap 150 and the cover 140, and a slot may be formed in the other one for receiving the hook. Therefore, it will be adequate as far as the protection cap 150 and the cover 140 have structures in which the user can fasten/unfasten the protection cap 150 to/from the cover 140, with easy.

FIGS. 3 and 4 illustrate an embodiment in which the protection cap 150 is projected from the cover 140. However, it may also be possible that the protection cap 150 is not projected from the cover 140, but almost flush with the cover 140.

The protection cap 150 provided to cover the opening 145 thus protects the water valve 120 fitted opposite to the opening 145 in the machinery chamber.

In the meantime, it is preferable that the cover 140 has a plurality of pass through holes 110. Then, the pass through holes 110 can make air flows in/out of the machinery chamber, heat generated at components, such as the compressor, condenser, and the like can be discharged to an outside of the machinery chamber, easily. Though not shown, the pass through holes 110 may be formed, not only in the cover 140, but also in the projection cap 150.

In the meantime, when it is intended to change a position of the refrigerator during use of the refrigerator, a position of the faucet the hose 130 may be connected thereto, or a required length of the hose 130 may differ. Therefore, it is required to disconnect the hose 130 from the water vale 120, move the refrigerator to a new position, and connect the hose again, which process will be described.

The screws or bolts that fasten the protection cap 150 to the cover 140 are unfastened, to unfasten, and detach the protection cap 150 from the cover. Then, the position of the refrigerator is changed.

Once the position of the refrigerator is changed, the hose 130 having an adequate length for connecting the water supply source, such as the faucet, to the water valve 120 is provided. Then, both ends of the hose 130 are connected to the water supply source, such as the faucet, and the water valve 120, respectively. In this instance, the serviceman can connect the hose 130 to the water valve 120 easily through the opening 145.

Once the hose 130 is connected to the water valve 120, the protection cap 150 is attached to the cover 140. Of course, the protection cap 150 is fastened to the cover 140 with screws or bolts.

Thus, in the refrigerator of the present invention, the opening is provided to the cover that covers the machinery chamber, and the opening is covered with the protection cap detachable from the cover. Therefore, after removing the protection cap from the cover by unfastening a small number of screws or bolts, the serviceman can connect/disconnect the hose to/from the water vale in the machinery chamber.

Moreover, the cover has an opening for the serviceman to insert a hand or a tool for service. According to this, the serviceman can connect/disconnect the water valve to the hose easily, and, if required a service, such as changing a position of the refrigerator, can be carried out easily.

Furthermore, since the protection cap protects the water valve, the water valve can be protected securely during production, transportation, and installation of the refrigerator.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A cover assembly of a machinery chamber in a refrigerator, comprising:

a cover for covering a machinery chamber having a valve provided thereto;

an opening provided in the cover, the opening being located adjacent to the valve and exposing the valve, the valve being connectable to a water line passing through the cover at a location adjacent to the opening for supplying water to the refrigerator; and a protection cap detachably fastened to the cover, the protection cap including a valve cover cap and a water line cap, the valve cover cap covering the valve exposed through the opening, the water line cap being for receiving the water line and permitting the water line to pass through the cover without passing through the valve cover cap.

2. The cover assembly as claimed in claim 1, wherein the cover is detachable from a cabinet the machinery chamber is formed therein.

3. The cover assembly as claimed in claim 1, wherein the cover is fastened to a cabinet having the machinery chamber formed therein.

4. The cover assembly as claimed in claim 1, wherein the opening has a size larger than a size of the valve.

5. The cover assembly as claimed in claim 1, wherein the opening exposes a portion at which the valve and the hose are connected.

6. The cover assembly as claimed in claim 1, wherein the water line cap covers the location adjacent to the opening where the water line passes through the cover without covering the opening.

7. The cover assembly as claimed in claim 1, wherein the water line cap permits the water line to pass therethrough and through the cover.

8. The cover assembly as claimed in claim 1, wherein the water line cap permits the water line to pass through the cover without passing through the opening.

9. A refrigerator, comprising:

a machinery chamber in a cabinet of the refrigerator having components provided therein, the components including a valve for supplying water to the refrigerator;

a cover attached to the cabinet to cover the machinery chamber;

an opening provided in the cover, the opening being located adjacent to the valve and exposing the valve, the valve being connectable to a water line passing through the cover at a location adjacent to the opening; and a protection cap detachably fastened to the cover, the protection cap including a valve cover cap and a water line cap, the valve cover cap covering the valve exposed through the opening, the water line cap being for receiving the water line and permitting the water line to pass through the cover without passing through the valve cover cap.

10. The refrigerator as claimed in claim 9, wherein the cover is detachable from the cabinet the machinery chamber is formed therein.

11. The refrigerator as claimed in claim 9, wherein the cover is fastened to the cabinet having the machinery chamber formed therein.

12. The refrigerator as claimed in claim 9, wherein the opening has a size larger than a size of the valve.

13. The refrigerator as claimed in claim 9, wherein the opening exposes a portion at which the valve and the hose are connected.

14. The refrigerator as claimed in claim 9, wherein the water line cap covers the location adjacent to the opening where the water line passes through the cover without covering the opening.

15. The refrigerator as claimed in claim 9, wherein the water line cap permits the water line to pass therethrough and through the cover.

16. The refrigerator as claimed in claim 9, wherein the water line cap permits the water line to pass through the cover without passing through the opening.

17. A cover assembly of a machinery chamber in a refrigerator, comprising:

a cover for covering a machinery chamber having a valve provided thereto;

an opening provided in the cover, the opening being located adjacent to the valve and exposing the valve, the valve being connectable to a water line passing through the cover at a location adjacent to the opening for supplying water to the refrigerator;

a protection cap detachably fastened to the cover to cover the opening; and a water line cap for covering the location adjacent to the opening where the water line passes through the cover without passing through the valve cover cap.

* * * * *